US008492320B2

(12) United States Patent
Miyamoto et al.

(10) Patent No.: US 8,492,320 B2
(45) Date of Patent: Jul. 23, 2013

(54) LUBRICANT COMPOSITION

(75) Inventors: Tetsuhiro Miyamoto, Ibaraki (JP); Akihiko Shimura, Ibaraki (JP); Toshio Nitta, Ibaraki (JP); Jiro Yurimoto, Ibaraki (JP)

(73) Assignee: NOK Klueber Co., Ltd., Tokyo (JP)

( * ) Notice: Subject to any disclaimer, the term of this patent is extended or adjusted under 35 U.S.C. 154(b) by 0 days.

(21) Appl. No.: 13/535,815

(22) Filed: Jun. 28, 2012

(65) Prior Publication Data

US 2012/0264663 A1 Oct. 18, 2012

Related U.S. Application Data

(63) Continuation of application No. 12/863,688, filed on Jul. 20, 2010, now abandoned.

(30) Foreign Application Priority Data

Feb. 1, 2008 (JP) ..... 2008-023250
Feb. 1, 2008 (JP) ..... 2008-023251

(51) Int. Cl.
*C10M 133/16* (2006.01)
*C10M 107/34* (2006.01)
*C10M 169/00* (2006.01)

(52) U.S. Cl.
USPC ..... 508/555; 508/113; 508/130; 508/136; 508/182; 508/403; 508/406; 508/582

(58) Field of Classification Search
USPC ..... 508/555, 106, 588, 182
See application file for complete search history.

(56) References Cited

U.S. PATENT DOCUMENTS

| | | | | |
|---|---|---|---|---|
| 3,810,874 | A | 5/1974 | Mitsch et al. | |
| 6,083,600 | A | 7/2000 | Kasai et al. | |
| 6,420,321 | B1 * | 7/2002 | Akiyama et al. | 508/554 |
| 2001/0012822 | A1 * | 8/2001 | Mohri et al. | 508/554 |
| 2008/0032904 | A1 * | 2/2008 | Watanabe et al. | 508/590 |
| 2009/0105105 | A1 * | 4/2009 | Hashida et al. | 508/555 |

FOREIGN PATENT DOCUMENTS

WO WO2006030632 A1 3/2006

* cited by examiner

*Primary Examiner* — Ellen McAvoy
*Assistant Examiner* — Vishal Vasisth
(74) *Attorney, Agent, or Firm* — K. David Crockett, Esq.; Niky Economy Syrengelas, Esq.; Crockett & Crockett, PC

(57) ABSTRACT

A lubricant composition which is suitable as a fluorine oil, fluorine grease, and which is excellent in stabilizability, as well as a lubricant composition which is suitable as a fluorine oil, fluorine grease, and which has excellent rust prevention properties while keeping a heat resistance.

14 Claims, No Drawings

LUBRICANT COMPOSITION

This application is a continuation of U.S. application Ser. No. 12/863,688, now abandoned, filed Jul. 20, 2010, which is the National Stage of International Application No. PCT/JP2009/051666 filed Jan. 30, 2009, which claims priority to Japanese Patent Applications JP 2008-023250 filed Feb. 1, 2008 and JP 2008-023251 filed Feb. 1, 2008.

TECHNICAL FIELD

The present invention relates to a lubricant composition, and particularly to a lubricant composition which is suitable as a fluorine oil, fluorine grease, and the like, and which is excellent in stabilizability (anti-degradation property).

BACKGROUND ART

Fluorine-based lubricants are widely used for lubrication of various machines such as vehicles, electric equipments, construction machines, information equipments, industrial machines, working machines, and parts constituting them. With recently increased speeds, decreased sizes, enhanced performances, and decreased weights of these machines, temperatures of the machines and peripherals thereof tend to be increasingly raised.

Further, lower friction and higher wear resistances are demanded for the lubricants because of exemplary reasons to improve manufacturing efficiencies using the various machines and to prolong maintenance intervals of the machines, and stabilizing properties are demanded for the lubricants because the lubricants are desired to be stably used in environments contacted with members having catalytic activities.

To improve high-temperature performances, there is typically adopted a technique to increase a viscosity of a base oil of a lubricant. Although this technique improves a heat resistance of the lubricant, its operability is deteriorated at a low temperature.

Patent Document 1 discloses a phosphonic acid compound containing a perfluoropolyether group as a fluorine-containing group. Such a compound dissolves in a fluorine oil, and is also excellent in lubricating ability. However, it is an actual circumstance that the compound is becoming incapable of satisfying the recently increased demand for stabilizing property.

Patent Document 2 discloses aryl sulfonate and phosphonate compounds each including, or without including, a mono- or poly-alkyleneoxide bonding group between phosphorus and a fluorocarbon group. Since these compounds each include a fluorine-containing group and a phosphoric acid group configured to form a C—O—P bond such that hydrolysis is caused to become inferior in heat resistance and durability, the compounds are disadvantageous in failing to exhibit a heat resistance which is an intrinsic feature of a fluorine oil/fluorine grease.

Patent Document 3 describes a lubricant for magnetic disk, which contains stabilizing compounds constituted of repeating units of —($CF_2O$)— and groups of CHNRR'. However, expensive methanesulfonyl chloride is required to produce these compounds, and specific reaction manipulation and the like are required then such as a reaction under an anhydrous condition, thereby bringing about a problem that scaling-up of the production to industrial dimensions is not easy.

Patent Document 4 discloses a compound having a pyridine ring, which exhibits an excellent performance for stability of a perfluoropolyether base agent. However, it is suggested that, in a production method to use a phase transfer catalyst and a pyridine derivative to obtain a corresponding fluorine-containing alcohol, there are required esterification and reduction reactions of a corresponding acid fluoride, so that the production method includes multiple stages (Patent Document 5).

Patent Document 6 describes to add an amide-based compound to a perfluoropolyether having a —($CF_2O$)— group in the presence of graphite or molybdenum disulfide, for improved durability. However, such durability is not sufficient yet in view of the demand in the market, and it is necessary to deal with increasingly severer demands in the market.

On the other hand, rust prevention properties are particularly required for lubricants, among such circumstances that rust prevention effects are demanded for lubricants in case of usage of equipments in seacoast areas and upon overseas transportation of parts, that lower friction and higher wear resistances are demanded for lubricants because of exemplary reasons to improve manufacturing efficiencies and to prolong maintenance intervals, and that lubricants are desired to be stably used in environments contacted with members having catalytic activities.

Patent Document 7 proposes a technique to use a fluorine grease composition for a rolling bearing, having an excellent antirust capability in addition to a durability at high temperatures, in a manner to add a magnesium compound and a volatile rust-preventive agent to the grease composition. Considering embodiments thereof, although benzotriazole is adopted as the used volatile rust-preventive agent to certainly succeed in providing the composition with a rust prevention capability, the adopted volatile rust-preventive agent comprising benzotriazole is apt to be thermally degraded such that usage thereof at high temperatures causes a lifetime of the lubricant itself to be shortened. Further, its solubility in a fluorine oil is low, and thus utilization thereof to a fluorine oil is impossible.

Patent Document 8 discloses carboxyl groups and amide derivatives, as additives having higher solubilities in fluorine oils. Although carboxyl groups and amide groups certainly form protective films for metals to thereby improve rust prevention capabilities, they are insufficient in thermal stability, so that usage thereof at high temperatures fails to continuously exhibit rust prevention effects.

Patent Document 9 discloses a fluorine grease usable from low temperatures to high temperatures, which includes, as rust prevention additives: disodium sebacate; sodium carbonate; and a carboxylic acid derivative containing a perfluoropolyether chain. Although these additives certainly allow for improvement of rust prevention capabilities, the additives are insufficient in usage for fluorine oils and greases to be used at high temperatures, from an aspect of solubilities in fluorine oils and an aspect of heat resistance.

Patent Document 10 proposes a technique to provide a rust prevention property, by a compound containing a perfluoropolyether chain having an aryl triazine end group.

However, the synthesizing process for the compound includes three stages, and thus it is unsuitable for scaling-up to industrial dimensions.

Further, since multiple by-products tend to be caused in the reaction of trichlorotriazine with $HOCH_2CF_2(OCF_2)_d(OCF_2CF_2)_cOCF_2CH_2OH$ for exemplarily obtaining a compound of its Example 8, it is necessary to strictly control the reaction conditions, thereby making it difficult to obtain the targeted substance with a satisfactory yield.

Patent Document 1: JP2003-027079A

Patent Document 2: JP2002-510697A

Patent Document 3: U.S. Pat. No. 6,083,600
Patent Document 4: JP2004-346318A
Patent Document 5: U.S. Pat. No. 3,810,874
Patent Document 6: WO2006/030632
Patent Document 7: JP9-59664A
Patent Document 8: JP2818242
Patent Document 9: JP2006-348291A
Patent Document 10: JP2006-290892A

DISCLOSURE OF INVENTION PROBLEM TO BE SOLVED BY THE INVENTION

It is therefore an object of the present invention to provide a lubricant composition which is suitable as a fluorine oil, fluorine grease, and the like, and which is excellent in stabilizability (anti-degradation property).

It is another object of the present invention to provide a lubricant composition which is suitable as a fluorine oil, fluorine grease, and the like, and which has an excellent rust prevention property while keeping a heat resistance.

Other objects of the present invention will become apparent from the following description.

Means For Solving Problem

The above objects are achieved by the following inventions.

The invention recited in the claims resides in a lubricant composition comprising a fluorine-containing diamide compound represented by the following Formula (I), and a lubricating oil:

Formula (I):

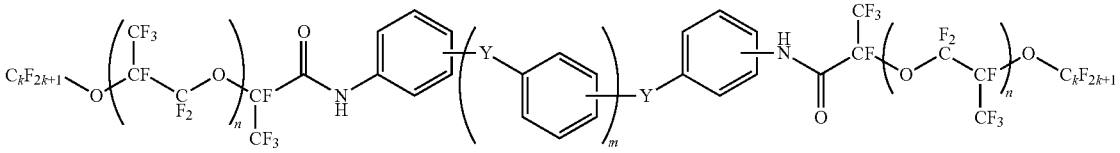

wherein,

Y represents an oxygen atom (O), sulfur atom (S), CO group, SO group, or $SO_2$ group;

k is an integer of 1 to 5;

m is an integer of 0 to 10; and n is an integer of 2 or more;

and wherein substituting positions of two substitutional groups possessed by each phenyl group may be any one of an ortho-position, meta-position, and para-position.

The invention recited in the claims resides in a lubricant composition excellent in rust prevention, comprising a fluorine-containing diamide compound represented by the above Formula (I), and a lubricating oil:

Wherein,

Y represents an oxygen atom (O), sulfur atom (S), CO group, SO group, or $SO_2$ group;

k is an integer of 1 to 5;

m is an integer of 0 to 10; and n is an integer of 1 or more;

and wherein substituting positions of two substitutional groups possessed by each phenyl group may be any one of an ortho-position, meta-position, and para-position.

The invention recited in the claims resides in the lubricant composition defined in the preceding paragraphs, wherein Y is an oxygen atom (O) or sulfur atom (S) in the Formula (I).

The invention recited in the claims resides in the lubricant composition defined in the preceding paragraphs, wherein the lubricating oil includes a perfluoropolyether oil having a kinematic viscosity of 5 to 2,000 $mm^2/s$ (40° C.).

The invention recited in the claims resides in the lubricant composition defined in the preceding paragraphs, further comprising a thickener.

The invention recited in the claims resides in the lubricant composition defined in the preceding paragraphs, wherein the thickener comprises fine particles having an averaged primary particle diameter of 0.01 to 50 μm, and the particles include at least one kind selected from fluororesin, silica, graphite, and carbon.

The invention recited in the claims resides in the lubricant composition of defined in the preceding paragraphs, wherein the thickener includes at least one kind selected from metallic soap, metallic complex soap, urea, and metal aliphatic dicarboxylate.

The invention recited in the claims resides in the lubricant composition defined in the preceding paragraphs, usable for a bearing, gear, linear guide, or magnetic disk.

Effect of the Invention

The present invention allows for provision of a lubricant composition which is suitable as a fluorine oil, fluorine grease, and the like, and which is excellent in stabilizability (anti-degradation property).

The present invention further allows for provision of a lubricant composition which is suitable as a fluorine oil, fluorine grease, and the like, and which has an excellent rust prevention property while keeping a heat resistance.

BEST MODE(S) FOR CARRYING OUT THE INVENTION

The embodiments of the present invention will be described hereinafter.

The lubricant compositions of the present invention each comprise a fluorine-containing diamide compound (additive) represented by the above Formula (I), and a lubricating oil (base oil), in a manner to embrace two kinds of lubricant compositions including one having an excellent stabilizability (anti-degradation property) and the other having an excellent rust prevention property, based on the same Formula (I). Note that both compositions are slightly different from each other, in terms of "n" in Formula (I).

<Fluorine-Containing Diamide Compound Represented by Formula (I)> wherein, Y represents an oxygen atom (O), sulfur atom (S), CO group, SO group, or $SO_2$ group, and preferably represents an oxygen atom (O) or sulfur atom (S).

k is an integer of 1 to 5, and preferably 1 to 3.

m is an integer of 0 to 10, preferably in a range of 1 to 5, and more preferably 1 or 2. m's exceeding 10 lead to increased viscosities of the additive, so that the additive becomes insoluble in a targeted base oil.

In case of providing a lubricant composition having an excellent stabilizability (anti-degradation property) in the present invention, n is an integer of 2 or more, and preferably in a range of 2 to 40. When n is less than 2, i.e., n=1, the evaporation amount of the additive is increased in a targeted high-temperature region, thereby failing to exhibit a function as an additive at the working temperature.

In turn, in case of providing a lubricant composition having an excellent rust prevention property in the present invention, n is an integer of 1 or more, and preferably in a range of 2 to 40. When n is less than 1, the evaporation amount of the additive is increased in the high-temperature region, while the level of the rust prevention effect is unchanged. However, a problem is brought about then, that the additive is insoluble in the base oil.

Substituting positions of two substitutional groups possessed by each phenyl group may be any one of an ortho-position, meta-position, and para-position.

The fluorine-containing diamide compound represented by the above Formula (I) can be exemplarily synthesized by reacting an acid fluoride substance represented by the following Formula (II) with a compound having a diamino group represented by the following Formula (III), in a pyridine solvent.

Formula (II):

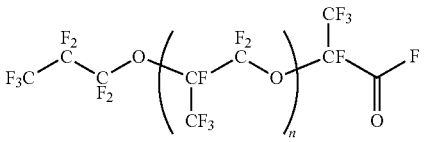

In case of providing a lubricant composition having an excellent stabilizability (anti-degradation property), n in Formula is an integer of 2 or more, and preferably in a range of 2 to 40. In turn, in case of providing a lubricant composition having an excellent rust prevention property, n in Formula is an integer of 1 or more, and preferably in a range of 2 to 40.

Formula (III):

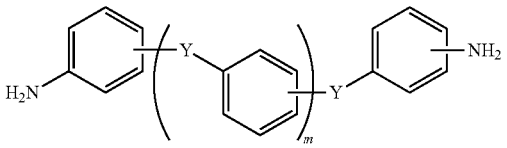

wherein, Y represents an oxygen atom (O), sulfur atom (S), CO group, SO group, or $SO_2$ group, and preferably represents an oxygen atom (O) or sulfur atom (S).

m is an integer of 0 to 10, preferably in a range of 1 to 5, and more preferably 1 or 2.

Substituting positions of two substitutional groups possessed by each phenyl group may be any one of an ortho-position, meta-position, and para-position.

The above synthetic method is conducted in a pyridine solvent which has an ability to trap hydrogen fluoride similarly to sodium fluoride in a manner to use a low toxic substance (pyridine), thereby avoiding such a problem otherwise attributing to sodium fluoride.

Toxicity and characteristics of pyridine are as follows.

Oral rat toxicity: LD50 890 mg/kg

Liquid at ordinary temperature (melting point: −42° C., and boiling point: 115.5° C.)

Pyridine as the solvent is not necessarily used solely, and it is possible to combiningly use other organic solvents to improve solubilities of starting compounds, reaction products, and the like.

Examples of the compound having a diamino group represented by Formula (III) include 1,4-bis(4-aminophenoxy) benzene, and such 1,4-bis(4-aminophenoxy)benzene is available as commercial products such as CAS Nos. 10526-07-5, 2479-46-1, and 3491-12-1.

Further, the compound having a diamino group may be an aromatic polyether where m=2 or more, and may be any one of compounds (CAS Nos. 141699-34-5, 60191-34-6, 17619-11-3, for example) where respective ether-bonding atoms O (oxygen atoms) are substituted by CO, S, SO, and $SO_2$, respectively.

Note that although the above synthetic method is applicable to a case that k is 3 in the compound represented by Formula (I), synthesis can be similarly conducted by adopting acid fluoride substances having different k's, respectively. It is important to use a pyridine solvent also in such cases.

<Lubricating Oil>

Preferably usable as the lubricating oil (which may be called "base oil" hereinafter, as required) in the present invention, is a perfluoropolyether oil represented by the following Formula (IV).

$RfO(CF_2O)_f(C_2F_4O)_g(C_3F_6O)_hRf$ Formula (IV):

wherein, Rf represents a perfluoro lower alkyl group having 1 to 5 carbon atoms, such as a perfluoromethyl group, and perfluoroethyl group.

Among perfluoropolyether oils represented by Formula (IV), examples of concrete compounds include perfluoropolyether oils of the following Formula (V) to Formula (VIII).

$RfO[CF(CF_3)CF_2O]_iRf$ Formula (V):

wherein, Rf is the same as the above definition, and i is an integer of 2 to 200.

The perfluoropolyether oil represented by Formula (V) is obtained: by completely fluorinating a precursor produced by photooxidation polymerization of hexafluoropropylene; or by anionically polymerizing hexafluoropropylene in the presence of cesium fluoride catalyst, and then treating the obtained acid fluoride compound having a $CF(CF_3)COF$ end group, with a fluorine gas.

$F[CF_2CF_2CF_2O]_{2\sim100}CF_2CF_3$ Formula (VI):

The perfluoropolyether oil represented by Formula (VI) is obtainable by anionically polymerizing 2,2,3,3-tetrafluorooxetane in the presence of cesium fluoride catalyst, and then treating the obtained fluorine-containing polyether $(CF_2CF_2CF_2O)_n$ with a fluorine gas at 160 to 300° C. with ultraviolet irradiation.

$RfO(CF_2CF_2O)_j(CF_2O)_kRf$ Formula (VII):

wherein, Rf is the same as the above definition, j+k=3 to 200, and j:k=10:90 to 90:10 in a randomly bonded manner.

The perfluoropolyether oil represented by Formula (VII) is obtainable by completely fluorinating a precursor produced by photooxidation polymerization of tetrafluoroethylene.

$RfO[CF(CF_3)CF_2O]_l(CF_2O)_mRf$ Formula (VIII):

wherein, Rf is the same as the above definition, l+m=3 to 200, and l:m=10:90 to 90:10 in a randomly bonded manner.

The perfluoropolyether oil represented by Formula (VIII) is obtainable by completely fluorinating a precursor produced by photooxidation polymerization of hexafluoropropene.

These perfluoropolyether oils (base oils) are usable singly, or mixedly with each other.

To be preferably used as a lubricating oil in the present invention, is a perfluoropolyether oil having a kinematic viscosity of 5 to 2,000 $mm^2/s$ (40° C.). The measuring method of kinematic viscosity here conforms to JIS K-2283 (Canon-Fenske viscometer).

Perfluoropolyether oils having kinematic viscosities lower than 5 $mm^2/s$ are large in evaporation amount, thereby failing to meet the condition of evaporation amount (1.5% or less) prescribed for three kinds of greases for JIS rolling bearing, as regulations of heat-resistant greases. In turn, perfluoropolyether oils having kinematic viscosities exceeding 2,000 $mm^2/s$ exhibit pour points (JIS K-2283) of 10° C. or higher such that bearings are not rotated upon actuation at low temperatures insofar as by a typical manner and thus heating is required to make the bearings operable, thereby failing to exhibit usage eligibility as typical greases. The more preferable range of viscosities (40° C.) is about 10 to 1,500 $mm^2/s$.

<Blending Ratio>

The composition including the above perfluoropolyether oil (base oil) and the fluorine-containing amide compound which is a novel primary amine derivative represented by Formula (I), is novel in an aspect of its combination.

The fluorine-containing amide compound is usable at a blending ratio of 0.1 to 20 mass %, and preferably 0.5 to 5 mass %, relative to the whole of the lubricant composition (oil composition). Blending ratios less than 0.1 mass % fail to obtain a sufficient effect as a lubricant. Blending ratios exceeding 20 mass % fail to exhibit performances commensurating with costs.

<Other Base Oils>

It is possible to mix a base oil other than the aforementioned perfluoropolyether oil into the lubricant composition of the present invention. However, such a base oil is separated from the perfluoropolyether oil even when the former is mixed with the latter, so that the lubricant composition is not directly usable as an oil. In this case, the thickener to be described later is blended into the lubricant composition, and the lubricant composition is used as a grease.

Types of base oils other than the perfluoropolyether oil are not particularly limited, and it is possible to use at least one kind of: hydrocarbon-based synthetic oils represented by poly-α-olefins, ethylene-α-olefin copolymers, polybutene, alkylbenzenes, and alkylnaphthalenes; ether oils such as polyalkylene glycols, ether oils such as various phenyl ethers, and the like; ester oils such as monoesters, diesters, polyolesters (neopentylglycol ester, trimethylolpropane ester, pentaerythritol ester, dipentaerythritol ester, complex ester, and the like), aromatic esters, and carbonic esters; various silicone oils; synthetic oils such as various fluorine oils; paraffin-based mineral oils; naphthene-based mineral oils; and mineral oils obtained by purifying the oils enumerated just above, by an appropriate combination of solvent purification, hydrogenation purification, and the like.

Types and natures of the various lubricating oils (base oils) other than perfluoropolyether oil are not particularly limited, and are appropriately selectable depending on working conditions.

The types of lubricating oils (base oils) are preferably synthetic oils, which have heat resistances superior to those of mineral oils, and which preferably include ester oils as main components, respectively.

Concerning natures of the lubricating oils, those preferably having kinematic viscosities (40° C.) in a range of about 2 to 1,000 $mm^2/s$, and more preferably about 5 to 500 $mm^2/s$ are used typically. Here, the measuring method of kinematic viscosity here conforms to JIS K-2283 (Canon-Fenske viscometer).

Adoption of lubricating oils having kinematic viscosities lower than the above-described range possibly causes increased evaporation losses, deteriorated oil film strengths, and the like to bring about lifetime deterioration, wear, seizure, and the like, while adoption of lubricating oils having kinematic viscosities exceeding the above-described range possibly causes increased viscous resistances and the like to bring about defects such as increased power consumptions, required torques, and the like.

<Thickener>

While the lubricant composition of the present invention is sufficiently usable as a fluorine oil, the lubricant composition is also effective as a grease in view of sealability. In this case, the lubricant composition includes a thickener blended therein.

In case that the lubricant composition is used as a grease, polytetrafluoroethylene (PTFE), tetrafluoroethylene-hexafluoropropene (FEP) copolymer, perfluoro alkylene resin, or the like is used as a thickener.

To be used as the polytetrafluoroethylene (PTFE) is that which has been once produced into polytetrafluoroethylene having a number-average molecular weight Mn of about 1,000 to 1,000,000 by a method such as emulsion polymerization, suspension polymerization, solution polymerization, or the like of tetrafluoroethylene, in a manner to subsequently treating the obtained polytetrafluoroethylene by a method such as thermal decomposition, electron-beam irradiation decomposition, physical pulverization, or the like to cause the polytetrafluoroethylene to have a number-average molecular weight Mn of about 1,000 to 500,000.

Further, the copolymerization reaction of tetrafluoroethylene with hexafluoropropene and the molecular weight decreasing treatment upon production of the tetrafluoroethylene-hexafluoropropene (FEP) copolymer are also conducted in the same manner as the case of polytetrafluoroethylene, and those copolymers are used which are prepared to have number-average molecular weights on the order of about 1,000 to 600,000. Note that it is possible to control a molecular weight of a copolymer, by using a chain transfer agent upon copolymerization reaction.

The obtained powdery fluororesin comprises fine particles which are typically 500 μm or less in diameter, preferably having an averaged primary particle diameter of 0.01 to 50 μm, more preferably an averaged primary particle diameter of 0.1 to 30 μm.

In the present specification, the averaged particle diameter in the term of "averaged primary particle diameter" means an arithmetic average of primary particle diameters of (100 or more) particles observed by an electron microscope. The term "primary particle diameter" means a diameter of each of particles of polytetrafluoroethylene and the like in the form of the smallest unit where the particles are not agglomerated, and means a maximum diameter of an individual particle which is measurable between two opposite points of the particle.

In addition to the above-described fluororesin particles, it is preferable in the present invention to use, as the thickener, at least one kind selected from among silica (silicon dioxide), graphite, carbon, and melamine cyanurate (MCA), $TiO_2$ (titanium oxide), as well as BN (boron nitride), which are fine particles having an averaged primary particle diameter of 0.01 to 50 μm.

Further, as the thickener other than the above-described ones, it is also possible to use metallic soaps such as Li soap, metallic complex soaps, urea resins, minerals such as bentonite, organic pigments, polyethylene, polypropylene, and polyamide.

From viewpoints of heat resistance and lubricating ability, it is desirable to use a metal aliphatic dicarboxylate, metal monoamide monocarboxylate, metal monoester carboxylate, diurea, triurea, tetraurea, and the like.

<Other Additive>

Within an extent that the object of the present invention is not affected, and as required, it is possible to add a known additive to be used in a lubricant including a typical synthetic oil as a base oil, such as a pour point depressant, ashless dispersant, metal-based cleaning agent, antioxidant, corrosion inhibitor, anti-foaming agent, wear resistant agent, and oiliness agent, depending on the usage.

Upon addition of such an additive, it is desirable to use a required minimum thereof, so as not to obstruct the heat resistance and low-temperature flowability of the final product, and compatibility thereof with a bearing material.

Examples of the pour point depressant include di(tetraparaffin phenol)phthalate, a condensation product of tetraparaffin phenol, a condensation product of alkyl naphthalene, a condensate of chlorinated paraffin-naphthalene, and alkylated polystyrene.

Examples of the ashless dispersant include succinic acid imide-based, succinic acid amide-based, benzylamine-based, and ester-based ashless dispersants.

Examples of the metal-based cleaning agent include metal sulfonates represented by dinonylnaphthalene sulfonic acid, metal salts of alkyl phenols, and metal salicylates.

Examples of the antioxidant include: phenol-based antioxidants such as 2,6-di-t-butyl-4-methylphenol, 4,4'-methylene-bis(2,6-di-t-butylphenol); amine-based antioxidants such as alkyldiphenylamines (where the alkyl group has 4 to 20 carbon atoms), triphenyldiamine, phenyl-α-naphthylamine, phenothiazine, alkylated phenyl-α-naphthylamine, phenithiazine, alkylated phenothiazine; phosphorus-based antioxidants; and sulfur-based antioxidants; which can be used solely or combinedly in two or more kinds.

Examples of the corrosion inhibitor include benzimidazole, benzotriazole, and thiadiazole.

Examples of the anti-foaming agent include dimethyl polysiloxanes, polyacrylic acids, metallic soaps, fatty acid esters, and phosphate esters.

Examples of the wear resistant agent include: phosphorus-based compounds such as phosphate esters, phosphite acid esters, phosphate ester amine salts; sulfur-based compounds such as sulfides and disulfides; chlorine-based compounds such as chlorinated paraffins, chlorinated diphenyl; and organo-metallic compounds such as zinc dialkyldithiophosphate (ZnDTP), and molybdenum dialkyldithiocarbamate (MoDTP).

Examples of the oiliness agent include fatty acids, higher alcohols, polyhydric alcohols, polyhydric alcohol esters, aliphatic esters, aliphatic amines, and fatty acid monoglycerides.

EXAMPLE

Although Examples of the present invention will be described hereinafter, the present invention is not limited to such Examples.

Example 1

10.1 g of 1,4-bis(4-aminophenoxy)benzene was dissolved in a mixed solvent of 100 ml of pyridine and 100 ml of AK-225 (mixture of $CF_3CF_2CHCl_2$ and $CClF_2CF_3CHClF$), followed by slow dropping of 209.0 g of acid fluoride (n=11) at a room temperature, and by stirring overnight under a condition ranging from the room temperature to 40° C.

50 ml of methanol was added and stirred, followed by subsequent neutralization with a saturated $NaHCO_3$ water solution.

The reaction product was extracted by AK-225 (mixture of $CF_3CF_2CHCl_2$ and $CClF_2CF_3CHClF$), and washed by a saturated NaCl water solution. The AK-225 was distilledly removed by an evaporator, to obtain a light yellow and highly viscous liquid (C-2).

With analysis of a chemical structure of C-2 by NMR, it was revealed that it had a structure of Formula (I), and n=11, m=1, and k=3. In view of the starting materials of synthesis, Y is supposed to be O (oxygen atom).

10 g of the obtained light yellow and highly viscous liquid (C-2) was added into 190 g of a base oil (A-1) represented by the following Formula, followed by stirring and mixing at 80° C. for 30 minutes and by cooling thereafter, to obtain a transparent solution.

$$RfO(CF_2CF_2O)_j(CF_2O)_kRf \quad \text{(A-1)}$$

Rf; perfluoro lower alkyl group

Viscosity (40° C.); 160 $mm^2/s$

This solution was used as a sample, such that 0.6 g of a test portion prepared by adding an iron powder (reagent) in an amount to occupy 10 wt % of the sample was collected onto a petri dish of glass of ϕ35 mm in a manner to uniformly coat the former onto the latter, and then the petri dish was left to stand still within a constant temperature bath at 250° C., to measure a weight reduction ratio (loss ratio) of the test portion after 50 hours. The result is shown in Table 1.

Example 2

10.1 g of 1,4-bis(4-aminophenoxy)benzene was dissolved in a mixed solvent of 100 ml of pyridine and 100 ml of AK-225, followed by slow dropping of 101.0 g of acid fluoride (n=40) at a room temperature, and by stirring overnight under a condition ranging from the room temperature to 40° C.

50 ml of methanol was added and stirred, followed by subsequent neutralization with a saturated $NaHCO_3$ water solution.

The reaction product was extracted by AK-225, and washed by a saturated NaCl water solution. The AK-225 was distilledly removed by an evaporator, to obtain a light yellow and highly viscous liquid (C-3).

With analysis of a chemical structure of C-3 by NMR, it was revealed that it had a structure of Formula (I), and n=40, m=1, and k=3. In view of the starting materials of synthesis, Y is supposed to be O (oxygen atom).

1 g of the obtained light yellow and highly viscous liquid (C-3) was added into 199 g of the base oil (A-1) used in Example 1, followed by stirring and mixing at 80° C. for 30 minutes and by cooling thereafter, to obtain a transparent solution.

This solution was used as a sample, and a weight reduction ratio (loss ratio) was measured in the same manner as Example 1. The result is shown in Table 1.

Example 3

3 g of bis[4-(aminophenoxy)phenyl]sulfone was dissolved in a mixed solvent of 100 ml of pyridine and 100 ml of AK-225, followed by slow dropping of 209.0 g of acid fluoride (n=11) at a room temperature, and by stirring overnight under a condition ranging from the room temperature to 40° C.

50 ml of methanol was added and stirred, followed by subsequent neutralization with a saturated $NaHCO_3$ water solution.

The reaction product was extracted by AK-225, and washed by a saturated NaCl water solution. The AK-225 was distilledly removed by an evaporator, to obtain a light yellow and highly viscous liquid (C-4).

With analysis of a chemical structure of C-4 by NMR, it was revealed that it had a structure of Formula (I), and n=11, m=2, and k=3. In view of the starting materials of synthesis, Y's are supposed to be an $SO_2$ group and O (oxygen atom).

6 g of the obtained light yellow and highly viscous liquid (C-4) was added into 194 g of the base oil (A-1) used in Example 1, followed by stirring and mixing at 80° C. for 30 minutes and by cooling thereafter, to obtain a transparent solution.

This solution was used as a sample, and a weight reduction ratio (loss ratio) was measured in the same manner as Example 1. The result is shown in Table 1.

Example 4

10 g of the liquid (C-2) obtained in Example 1, 130 g of the base oil (A-1), and 60 g of a thickener (B-1) (polytetrafluoroethylene based on emulsion polymerization: molecular weight of about 100,000 to 200,000; and averaged primary particle diameter of 0.2 μm) were agitated and mixed, followed by kneading by three rolls, to obtain a white grease-like substance.

This grease-like substance was used as a sample, and a weight reduction ratio (loss ratio) was measured in the same manner as Example 1. The result is shown in Table 1.

Example 5

2 g of the liquid (C-4) obtained in Example 3, 13 g of the base oil (A-1), and 60 g of a thickener (B-2) (polytetrafluoroethylene based on suspension polymerization: molecular weight of about 10,000 to 100,000; and averaged primary particle diameter of 5 μm) were agitated and mixed, followed by kneading by three rolls, to obtain a white grease-like substance.

This grease-like substance was used as a sample, and a weight reduction ratio (loss ratio) was measured in the same manner as Example 1. The result is shown in Table 1.

Example 6

6 g of the liquid (C-3) obtained in Example 2, 64 g of the base oil (A-1), 86 g of the following base oil (A-5), 30 g of the thickener (B-1), and 14 g of a thickener (B-3) (aliphatic diurea) were agitated and mixed, followed by kneading by three rolls, to obtain a white grease-like substance.

This grease-like substance was used as a sample, and a weight reduction ratio (loss ratio) was measured in the same manner as Example 1. The result is shown in Table 1.

(A-5)

Dipentaerythritol fatty acid ester (ADEKA PROVER H-450 manufactured by ADEKA Corporation)

Example 7

4 g of the liquid (C-3) obtained in Example 2, 130 g of the base oil (A-1), 56 g of the thickener (B-1), and 10 g of a thickener (B-4) (sodium sebacate) were agitated and mixed, followed by kneading by three rolls, to obtain a white grease-like substance.

This grease-like substance was used as a sample, and a weight reduction ratio (loss ratio) was measured in the same manner as Example 1. The result is shown in Table 1.

Comparative Example 1

There was measured a weight reduction ratio (loss ratio) in the same manner as Example 1 except that only the base oil (A-1) was used as a sample in itself, and an iron powder was added thereto. The result is shown in Table 1.

Comparative Example 2

29.5 g of 1,4-bis(4-aminophenoxy)benzene was dissolved in 200 ml of pyridine, followed by slow dropping of 124 g of acid fluoride (n=1) on an ice bath, and by stirring overnight under a condition ranging from 0° C. to a room temperature.

50 ml of methanol was added and stirred, followed by subsequent neutralization with a saturated $NaHCO_3$ water solution.

The reaction product was extracted by AK-225, and washed by a saturated NaCl water solution. The AK-225 was distilledly removed by an evaporator, to obtain a yellow powder (C-1) (124.8 g, 99.1%).

It was revealed that C-1 had a chemical structure of Formula (I), and n=1, m=1, and k=3. In view of the starting materials of synthesis, Y is supposed to be O (oxygen atom).

10 g of the obtained yellow powder (C-1) was added into 190 g of the base oil (A-1) used in Example 1, followed by stirring and mixing at 80° C. for 30 minutes and by cooling thereafter, to obtain a transparent solution.

This solution was used as a sample, and a weight reduction ratio (loss ratio) was measured in the same manner as Example 1. The result is shown in Table 1.

Comparative Example 3

There was obtained a transparent solution, by using the following (C-5) instead of (C-1) in Comparative Example 2.

This solution was used as a sample, and a weight reduction ratio (loss ratio) was measured in the same manner as Example 1. The result is shown in Table 1.

$$(RfO[CF(CF_3)CF_2O]_pCF(CF_3)CONHC_6H_{12}NH_2) \quad \text{(C-5)}$$

Comparative Example 4

6 g of the following (C-6) was added to 194 g of the base oil (A-1), to obtain a transparent solution in the same manner as Comparative Example 2.

This solution was used as a sample, and a weight reduction ratio (loss ratio) was measured in the same manner as Example 1.

The result is shown in Table 1.

$$(RfO[CF(CF_3)CF_2O]_pCF(CF_3)CONHC_6H_{12}NHCOCF(CF_3)[OCF_2CF(CF_3)]_pORf) \quad \text{(C-6)}$$

Comparative Example 5

There was obtained a transparent solution in the same manner as Comparative Example 2, except that the following (C-7) was used instead of (C-1).

This solution was used as a sample, and a weight reduction ratio (loss ratio) was measured in the same manner as Example 1. The result is shown in Table 1.

$$(RfO[CF(CF_3)CF_2O]_pCF(CF_3)CONHC_6H_{12}NHCH_2CH_3) \quad (C\text{-}7)$$

Comparative Example 6

There was obtained a transparent solution in the same manner as Comparative Example 4, except that the following (C-8) was used instead of (C-6).

This solution was used as a sample, and a weight reduction ratio (loss ratio) was measured in the same manner as Example 1.

The result is shown in Table 1.

$$(RfO[CF(CF_3)CF_2O]_pCF(CF_3)CONHC_4H_8NHCOCF(CF_3)[OCF_2CF(CF_3)]_pORf) \quad (C\text{-}8)$$

Comparative Example 7

There was obtained a transparent solution in the same manner as Comparative Example 4, except that the following (C-9) was used instead of (C-6).

This solution was used as a sample, and a weight reduction ratio (loss ratio) was measured in the same manner as Example 1. The result is shown in Table 1.

$$(C_3H_7O[CF_2CF(CF_3)O]_tCF(CF_3)(CH_2)_2PO(OC_2H_5)_2,\ 2\leqq t\leqq 6) \quad (C\text{-}9)$$

Comparative Example 8

There was obtained a transparent solution in the same manner as Comparative Example 4, except that the following (C-10) was used instead of (C-6).

This solution was used as a sample, and a weight reduction ratio (loss ratio) was measured in the same manner as Example 1. The result is shown in Table 1.

$$(C_3H_7O[CF_2CF(CF_3)O]_uCF(CF_3)(CH_2)_2PO(OC_6H_5)_2,\ 2\leqq u\leqq 6) \quad (C\text{-}10)$$

TABLE 1

| | Base oil | | Thickener | | Additive | | Weight reduction ratio |
|---|---|---|---|---|---|---|---|
| | Type | Percentage | Type | Percentage | Type | Percentage | |
| Example 1 | A-1 | 95% | | | C-2 | 5% | 9 wt % |
| Example 2 | A-1 | 99.5% | | | C-3 | 0.5% | 33 wt % |
| Example 3 | A-1 | 97% | | | C-4 | 3% | 36 wt % |
| Example 4 | A-1 | 65% | B-1 | 30% | C-2 | 5% | 6 wt % |
| Example 5 | A-1 | 69% | B-2 | 30% | C-4 | 1% | 7 wt % |
| Example 6 | A-1 | 32% | B-1 | 15% | C-3 | 3% | 51 wt % |
| | A-5 | 43% | B-3 | 7% | | | |
| Example 7 | A-1 | 65% | B-1 | 28% | C-3 | 2% | 6 wt % |
| | | | B-4 | 5% | | | |
| Comparative Example 1 | A-1 | 100% | | | | | 90 wt % |
| Comparative Example 2 | A-1 | 95% | | | C-1 | 5% | 90 wt % |
| Comparative Example 3 | A-1 | 95% | | | C-5 | 5% | 89 wt % |
| Comparative Example 4 | A-1 | 97% | | | C-6 | 3% | 88 wt % |
| Comparative Example 5 | A-1 | 95% | | | C-7 | 5% | 90 wt % |
| Comparative Example 6 | A-1 | 97% | | | C-8 | 3% | 90 wt % |

TABLE 1-continued

| | Base oil | | Thickener | | Additive | | Weight reduction ratio |
|---|---|---|---|---|---|---|---|
| | Type | Percentage | Type | Percentage | Type | Percentage | |
| Comparative Example 7 | A-1 | 97% | | | C-9 | 3% | 90 wt % |
| Comparative Example 8 | A-1 | 97% | | | C-10 | 3% | 88 wt % |

Example 8

29.5 g of 1,4-bis(4-aminophenoxy)benzene was dissolved in 200 ml of pyridine, followed by slow dropping of 124 g of acid fluoride (n=1) on an ice bath, and by stirring overnight under a condition ranging from 0° C. to a room temperature.

50 ml of methanol was added and stirred, followed by subsequent neutralization with a saturated $NaHCO_3$ water solution.

The reaction product was extracted by AK-225 (mixture of $CF_3CF_2CHCl_2$ and $CClF_2CF_3CHClF$), and washed by a saturated NaCl water solution. The AK-225 was distilledly removed by an evaporator, to obtain a yellow powder (C-1) (124.8 g, 99.1%).

It was revealed that C-1 had a chemical structure of Formula (I), and n=1, m=1, and k=3. In view of the starting materials of synthesis, Y is supposed to be O (oxygen atom).

2 g of the obtained yellow powder (C-1) was added into 198 g of a base oil (A-1) represented by the following Formula, followed by stirring and mixing at 80° C. for 30 minutes and by cooling thereafter, to obtain a white cloudy solution.

$$RfO(CF_2CF_2O)_j(CF_2O)_kRf \quad (A\text{-}1)$$

Rf; perfluoro lower alkyl group

Viscosity (40° C.); 160 $mm^2/s$

This solution was subjected to conduction of a rust prevention test (temperature: 49° C., humidity: 95%, and 50 hours) according to JIS K2246.

The samples were evaluated into five grades based on rust generation rate (%) after 50 hours, according to the criterion shown in Table 2. The evaluation method is shown in Table 2.

Example 9

10.1 g of 1,4-bis(4-aminophenoxy)benzene was dissolved in a mixed solvent of 100 ml of pyridine and 100 ml of AK-225, followed by slow dropping of acid fluoride (n=11, 209.0 g) at a room temperature, and by stirring overnight under a condition ranging from the room temperature to 40° C.

50 ml of methanol was added and stirred, followed by subsequent neutralization with a saturated $NaHCO_3$ water solution.

The reaction product was extracted by AK-225, and washed by a saturated NaCl water solution. The AK-225 was distilledly removed by an evaporator, to obtain a light yellow and highly viscous liquid (C-2) (173.9 g, 96.3%).

With analysis of a chemical structure of C-2 by NMR, it was revealed that it had a structure of Formula (I), and n=11, m=1, and k=3. In view of the starting materials of synthesis, Y is supposed to be O (oxygen atom).

6 g of the obtained light yellow and highly viscous liquid (C-2) was added into 194 g of the base oil (A-1), followed by stirring and mixing at 80° C. for 30 minutes and by cooling thereafter, to obtain a transparent solution.

This solution was subjected to conduction of the rust prevention test in the same manner as Example 8.

Example 10

2 g of 1,4-bis(4-aminophenoxy)benzene was dissolved in a mixed solvent of 100 ml of pyridine and 100 ml of AK-225, followed by slow dropping of acid fluoride (n=40, 101.0 g) at a room temperature, and by stirring overnight under a condition ranging from the room temperature to 40° C.

50 ml of methanol was added, followed by stirring, and by subsequent neutralization with a saturated $NaHCO_3$ water solution.

The reaction product was extracted by AK-225, and washed by a saturated NaCl water solution. The AK-225 was distilledly removed by an evaporator, to obtain a light yellow and highly viscous liquid (C-3) (97.6 g, 99.6%).

With analysis of a chemical structure of C-3 by NMR, it was revealed that it had a structure of Formula (I), and n=40, m=1, and k=3. In view of the starting materials of synthesis, Y is supposed to be O (oxygen atom).

2 g of the obtained light yellow and highly viscous liquid (C-3) was added into 198 g of the base oil (A-1), followed by stirring and mixing at 80° C. for 30 minutes and by cooling thereafter, to obtain a transparent solution.

This solution was subjected to conduction of the rust prevention test in the same manner as Example 8.

Example 11

There was obtained a solution in the same manner as Example 10, except that 196 g of the following base oil (A-2) was used instead of A-1, and C-3 was used in an amount of 4 g; and the rust prevention test was subsequently conducted.

$$RfO(CF(CF_3)CF_2O)_1(CF_2O)_mRf \quad (A\text{-}2)$$

Rf; perfluoro lower alkyl group

Viscosity (40° C.); 400 $mm^2/s$

Example 12

There was obtained a solution in the same manner as Example 10, except that that 190 g of the following base oil (A-3) was used instead of A-1, and C-3 was used in an amount of 10 g; and the rust prevention test was subsequently conducted.

$$RfO(CF(CF_3)CF_2O)_iRf \quad (A\text{-}3)$$

Rf; perfluoro lower alkyl group

Viscosity (40° C.); 100 $mm^2/s$.

Example 13

3 g of bis[4-(aminophenoxy)phenyl]sulfone was dissolved in a mixed solvent of 100 ml of pyridine and 100 ml of AK-225, followed by slow dropping of acid fluoride (n=11, 209.0 g) at a room temperature, and by stirring overnight under a condition ranging from the room temperature to 40° C.

50 ml of methanol was added and stirred, followed by subsequent neutralization with a saturated $NaHCO_3$ water solution.

The reaction product was extracted by AK-225, and washed by a saturated NaCl water solution. The AK-225 was distilledly removed by an evaporator, to obtain a light yellow and highly viscous liquid (C-4).

With analysis of a chemical structure of C-4 by NMR, it was revealed that it had a structure of Formula (I), and n=11, m=2, and k=3. In view of the starting materials of synthesis, Y's are supposed to be an $SO_2$ group and O (oxygen atom).

10 g of the obtained light yellow and highly viscous liquid (C-4) was added into 190 g of a base oil (A-4) represented by the following Formula, followed by stirring and mixing at 80° C. for 30 minutes and by cooling thereafter, to obtain a transparent solution.

$$F[CF_2CF_2CF_2O]_mRf \quad (A\text{-}4)$$

viscosity (40° C.): 200 $mm^2/s$

This solution was subjected to conduction of the rust prevention test in the same manner as Example 8.

Example 14

2 g of the (C-2) obtained in Example 9, 138 g of the base oil (A-1), and 60 g of a thickener (B-1) (polytetrafluoroethylene based on emulsion polymerization: molecular weight of about 100,000 to 200,000; and averaged primary particle diameter of 0.2 μm) were agitated and mixed, followed by kneading by three rolls, to obtain a white grease-like substance.

This grease-like substance was used as a sample, and subjected to conduction of the rust prevention test in the same manner as Example 8.

Comparative Example 9

The rust prevention test was conducted for only the base oil (A-1) in the same manner as Example 8.

Comparative Example 10

The rust prevention test was conducted for only the base oil (A-2) in the same manner as Example 9.

Comparative Example 11

The rust prevention test was conducted for only the base oil (A-3) in the same manner as Example 9.

Comparative Example 12

The rust prevention test was conducted for only the base oil (A-4) in the same manner as Example 9.

Table 3 shows compositions of Examples 8 to 14 and Comparative Examples 9 to 12, and evaluations by the rust prevention test.

TABLE 2

| Grade | Rust generation rate (%) |
|---|---|
| Grade A | 0 |
| Grade B | 1~10 |
| Grade C | 11~25 |
| Grade D | 26~50 |
| Grade E | 51~100 |

TABLE 3

| | Base oil | | Additive | | Thickener | | Evaluation |
|---|---|---|---|---|---|---|---|
| | Type | Percentage | Type | Percentage | Type | Percentage | after 50 hours |
| Example 8 | A-1 | 99% | C-1 | 1% | | | Grade A |
| Example 9 | A-1 | 97% | C-2 | 3% | | | Grade A |

TABLE 3-continued

| | Base oil | | Additive | | Thickener | | Evaluation |
|---|---|---|---|---|---|---|---|
| | Type | Percentage | Type | Percentage | Type | Percentage | after 50 hours |
| Example 10 | A-1 | 99% | C-3 | 1% | | | Grade A |
| Example 11 | A-2 | 98% | C-3 | 2% | | | Grade A |
| Example 12 | A-3 | 95% | C-3 | 5% | | | Grade A |
| Example 13 | A-4 | 95% | C-4 | 5% | | | Grade A |
| Example 14 | A-1 | 69% | C-2 | 1% | B-1 | 30% | Grade A |
| Comparative Example 9 | A-1 | 100% | | | | | Grade C |
| Comparative Example 10 | A-2 | 100% | | | | | Grade C |
| Comparative Example 11 | A-3 | 100% | | | | | Grade C |
| Comparative Example 12 | A-4 | 100% | | | | | Grade C |

Example 15

Conducted for the grease-like substance obtained in Example 14 was a rust prevention test in conformity to the prescription of DIN51802 (ENCOR test, temperature: room temperature; test time: 165 hours; rotational speed: 80 rpm; test medium: distilled water). After lapse of the test time, rust generation of a bearing was evaluated into six grades based on the criterion shown in Table 4. The evaluation result is shown in Table 5.

Comparative Example 13

There was obtained a white grease-like substance in the same manner as Example 14, except that the additive (C-2) was excluded, and the base oil (A-1) was increased to 140 g. This grease-like substance was evaluated for rust generation in the same manner as Example 15. The evaluation result is shown in Table 5.

TABLE 4

| Rating | Degree of corrosion | Description |
|---|---|---|
| 0 | No corrosion | — |
| 1 | Trace of corrosion | Not more than 3 corrosion sites, none having a diameter greater than 1 mm |
| 2 | Slight corrosion | Corrosion covering not more than 1% of surface, but more or larger corrosion sites than for rating 1 |
| 3 | Moderate ccorrosion | Corrosion covering more than 1%, but not more than 5% of surfice |
| 4 | Severer Corrosion | Corrosion covering more than 5%, but not more than 10% of surface |
| 5 | Very severe corrosion | Corrosion covering more than 10% of surface |

TABLE 5

| | Composition | | | | | | |
|---|---|---|---|---|---|---|---|
| | Base oil | | Thickener | | Additive | | |
| | Type | Percentage | Type | Percentage | Type | Percentage | Evaluation |
| Example 15 | A-1 | 69% | B-1 | 30% | G-2 | 1% | 0 |
| Comparative Example 13 | A-1 | 70% | B-1 | 30% | — | — | 2 |

Industrial Applicability

The present invention is applicable to those fields where a lubricant is used, and particularly to those fields where a lubricant composition (particularly, as an oil, grease, or dispersion) is used which possesses a lubricating ability, stabilizability (anti-degradation property), and/or rust prevention property, and which is stably usable for a long time.

Examples of the applicable fields include those of: various machines/equipments such as auxiliary equipment of vehicles, electric equipments, construction machines, information equipments, industrial machines, working machines, acoustic imaging equipments, precision/electric/electronic instruments like LBP's, business machines, PC's, recording media like HDD, crossing gates, electric contacts, semiconductor manufacturing machines, household electric appliances, clean rooms, dampers, metal working machines, transportation equipments, OEM equipments in automobile industry, railroad/watercraft/airplane equipments, food/pharmaceutical industry machines, iron and steel industry machines, mining/glass/cement industry machines, chemical/rubber/resin industry machines, film tenters, paper making industry machines, printing industry machines, wood processing industry machines, fiber/apparel industry machines, machine parts to be relatively moved, internal combustion engines, and pumps; and parts constituting them. More specifically, examples of the applicable fields include industrial fields configured to use: bearings such as rolling bearings, ball bearings, roller bearings, angular bearings, thrust bearings, oil-impregnated bearings, ferrous bearings, copper bearings, dynamic pressure bearings, resin bearings, inner race rotating bearings, and outer race rotating bearings; linear motion devices such as ball screws and linear motion bearings; power transmission equipments such as speed reducing gears, speed increasing gears, gears, chains, chain bushes, and motors; hydraulic/pneumatic valve-tap/seal equipments such as vacuum pumps, valves, pneumatic sealing equipments; working machines such as power tools; and fixed rollers, spindles, torque limiters, engines, alternators, tension pulleys, idler pulleys, fuel pumps, oil pumps, suction systems/fuel systems, throttles, electronic controlling throttles, exhaust system parts (such as exhaust gas circulating devices), cooling systems, electromotive fan motors, fan couplings, water pumps, air conditioning systems, compressors, running systems, hub-bearings, braking systems, ABS, brakes, steering systems, power steerings, suspension systems, driving systems, ball joints, transmissions, interior/exterior systems (power windows, headlights, door mirror optical axis adjusters), fuel cells, linear guides, electric contacts, AT switches, combination switches, and power window switches.

The invention claimed is:

1. A method for improving heat resistance of a lubricating oil including at least a perfluoropolyether oil represented by the following General Formula (A), comprising the steps of:

preventing decomposition of the perfluoropolyether oil at high temperatures by adding a fluorine-containing diamide compound represented by the following Formula (I) in the range of 0.5 to 5 wt % based on the lubricating oil, dissolving it in the perfluoropolyether oil and making a solution:

$RfO(CF_2CF_2O)_j(CF_2O)_kRf$ General Formula (A);

wherein,

Rf represents a perfluoro lower alkyl group having 1 to 5 carbon atoms, j+k=3 to 200, and j:k=10:90 to 90:10, and each repeating unit is randomly bonded;

Formula (I):

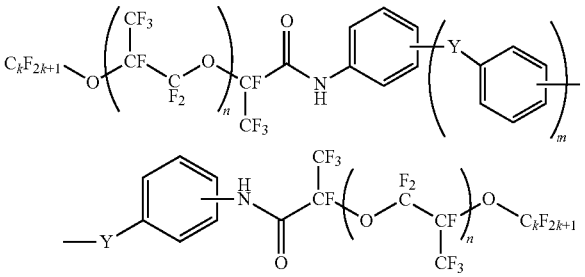

wherein,

Y represents an oxygen atom (O), sulfur atom (S), CO group, SO group, or $SO_2$ group;

k is an integer of 1 to 5;

m is an integer of 1 to 2; and

Formula (I):

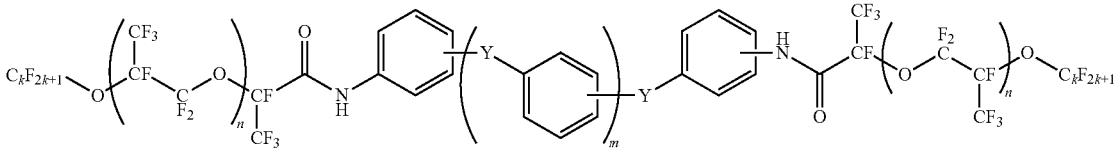

n is an integer of 11 to 40;

and wherein substituting positions of two substitutional groups possessed by each phenyl group may be any one of an ortho-position, meta-position, and para-position.

2. The method for improving heat resistance of the lubricating oil including the perfluoropolyether oil of claim 1, wherein in the Formula (I), Y is an oxygen atom (O) or a sulfur atom (S).

3. The method for improving heat resistance of the lubricating oil including the perfluoropolyether oil of claim 1, wherein the lubricant oil comprises the perfluoropolyether oil having a kinematic viscosity of 5 to 2,000 $mm^2/s$ (40° C.).

4. The method for improving heat resistance of the lubricating oil including the perfluoropolyether oil of claim 1, wherein the lubricating oil further comprises a thickener.

5. The method for improving heat resistance of the lubricating oil including the perfluoropolyether oil of claim 4, wherein the thickener comprises fine particles having an average primary particle diameter of 0.01 to 50 μm, and the particles include at least one kind selected from fluororesin, silica, graphite, and carbon.

6. The method for improving heat resistance of the lubricating oil including the perfluoropolyether oil of claim 4, wherein the thickener includes at least one kind selected from metallic soap, metallic complex soap, urea, and metal aliphatic dicarboxylate.

7. The method for improving heat resistance of the lubricating oil including the perfluoropolyether oil of claim 1, wherein the method is usable for a bearing, a gear, a linear guide, or a magnetic disk.

8. A method of reducing the rust generation rate of a first component having a sliding surface that engages with a sliding surface of a second component where the sliding surface of the first component and the sliding surface of the second component move relative to each other comprising:

providing a rust-preventing property to a lubricant composition including a perfluoropolyether oil by adding a fluorine-containing diamide compound represented by the following Formula (I) in the range of 0.5 to 5 wt % based on the lubricant composition, dissolving it in the perfluoropolyether oil represented by the following general formula (A) or (B) and making a solution and making a lubricant composition and applying the lubricant composition to the sliding surface of the first component and the sliding surface of the second component:

$RfO(CF_2CF_2O)_j(CF_2O)_kRf$ General Formula (A);

wherein,

Rf represents a perfluoro lower alkyl group having 1 to 5 carbon atoms, j+k=3 to 200, and j:k =10:90 to 90:10, and each repeating unit is randomly bonded;

$F[CF_2CF_2CF_2O]_mRf$ General Formula (B);

wherein,

Rf represents a perfluoro lower alkyl group having 1 to 5 carbon atoms, m=2 to 100;

wherein,

Y represents an oxygen atom (O), sulfur atom (S), CO group, SO group, or $SO_2$ group;

k is an integer of 1 to 5;

m is an integer of 1 to 2; and n is an integer of 11 to 40;

and wherein substituting positions of two substitutional groups possessed by each phenyl group may be any one of an ortho-position, meta-position, and para-position.

9. The method of reducing the rust generation rate of the moving component of claim 8, wherein in the Formula (I), Y is an oxygen atom (O) or a sulfur atom (S).

10. The method of reducing the rust generation rate of the moving component of claim 8, wherein the lubricant oil comprises the perfluoropolyether oil having a kinematic viscosity of 5 to 2,000 $mm^2/s$ (40° C.).

11. The method of reducing the rust generation rate of the moving component of claim 8, wherein the lubricating oil further comprises a thickener.

12. The method of reducing the rust generation rate of the moving component of claim 11, wherein the thickener comprises fine particles having an average primary particle diameter of 0.01 to 50 μm, and the particles include at least one kind selected from fluororesin, silica, graphite, and carbon.

13. The method of reducing the rust generation rate of the moving component of claim 11, wherein the thickener includes at least one kind selected from metallic soap, metallic complex soap, urea, and metal aliphatic dicarboxylate.

14. The method of reducing the rust generation rate of the moving component of claim 8, wherein the method is usable for a bearing, a gear, a linear guide, or a magnetic disk.

* * * * *